United States Patent [19]

Anderson et al.

[11] 4,008,447

[45] Feb. 15, 1977

[54] MINIATURE ELECTRICAL RELAY

[75] Inventors: Joseph Anderson; Joseph Louis Lagasse; Satinder Singh, all of Montreal; Victor Milalauskas, St. Laurent, all of Canada

[73] Assignee: Northern Electric Company, Montreal, Canada

[22] Filed: Nov. 14, 1975

[21] Appl. No.: 631,939

[52] U.S. Cl. ..... 335/128; 335/132

[51] Int. Cl.[2] ..... H01H 67/02

[58] Field of Search ..... 335/128, 129, 132, 187, 335/192, 276

[56] References Cited

UNITED STATES PATENTS 3,701,066 10/1972 Bosch et al. ..... 335/274

3,821,674 6/1974 Aidn et al. ..... 335/274 X

*Primary Examiner*—George Harris

*Attorney, Agent, or Firm*—Sidney T. Jelly

[57] ABSTRACT

A miniature electrical relay, particularly for telecommunications systems, has the armature releasably attached to the armature hinge spring by arranging for the armature and hinge spring to be of U formation, the ends of the legs of the armature and hinge overlapping, and with projections on one of the sets of legs engaging in recesses in the other set of legs. This avoids brazing or other more permanent ways of attachment and reduces fatigue fractures.

6 Claims, 7 Drawing Figures

MINIATURE ELECTRICAL RELAY

This invention relates to electrical relays and in particular to electrical relays for telecommunications systems.

The need to conserve space, to improve reliability and reduce manufacturing costs has resulted in considerable redesign of the normal telephone switching relay particularly to miniaturize it. Reduced material costs and increased density are two advantages. There is also a reduction in operating power, of considerable importance in large switching offices.

Essentially a relay comprises one or more sets of contacts, an electro-magnetically actuated armature which actuates the contacts - breaking one set and making the other, and mounting means for the armature. Generally, although not always, the mounting means for the armature acts to return the armature to its inactive position and yet permits easy pivotting of the armature on actuation of the electro-magnetic system.

One source of trouble is the connection of the armature to the hinge spring. Conventionally the armature is brazed or staked to the spring and breakage as a result of fatigue often occurs after a period of service.

The present invention provides a simple and economic connection of armature to the hinge spring. This, and other features improving the efficient operation of a relay will be understood by the following description of an embodiment, by way of example, in conjunction with the accompanying drawings, in which.

Figure 2:
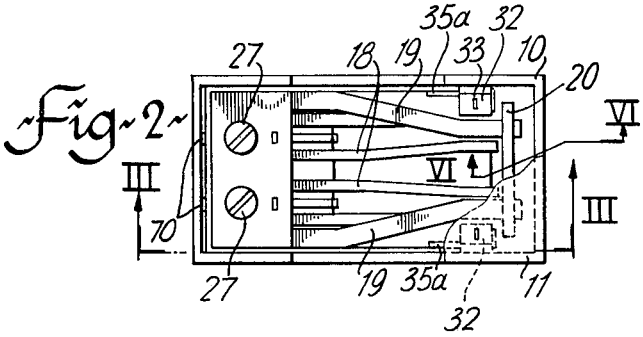
FIG. 2 is a bottom plan view of the relay of FIG. 1 with the base plate mostly removed.
Figure 1:
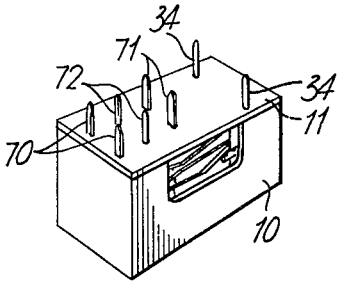
FIG. 1 is a perspective view of a relay viewed from the base.
Figure 3:
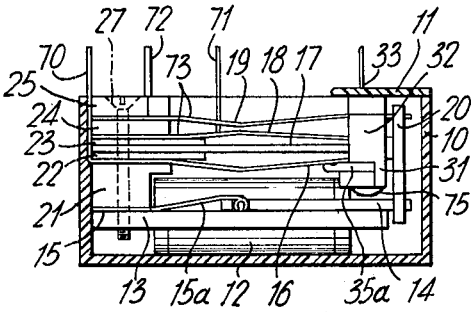
FIG. 3 is a cross-section on the line III—III of FIG. 2.

As illustrated in FIGS. 1, 2 and 3, a relay comprises a housing 10 and a base plate 11, forming an enclosure for the relay mechanism. The relay mechanism comprises a coil 12 on a centre leg of a core 13, an armature 14 with hinge spring 15, as assemblage of springs and contacts including break contact spring 16, transfer spring 17, make contact spring 18, return spring 19 and card 20. Various insulators are positioned between various items, as indicated at 21, 22, 23 24 and 25. The whole assemblage is held together by screws passing through holes in insulators and springs and screwing into threaded holes in the core. The various springs and insulators 22, 23 and 24 have oversize holes relative to the holes in the insulators, and hollow bosses 26 formed on the bottom insulator 25 pass through the various holes to avoid electrical shorting between springs via the screws.

Figure 4:
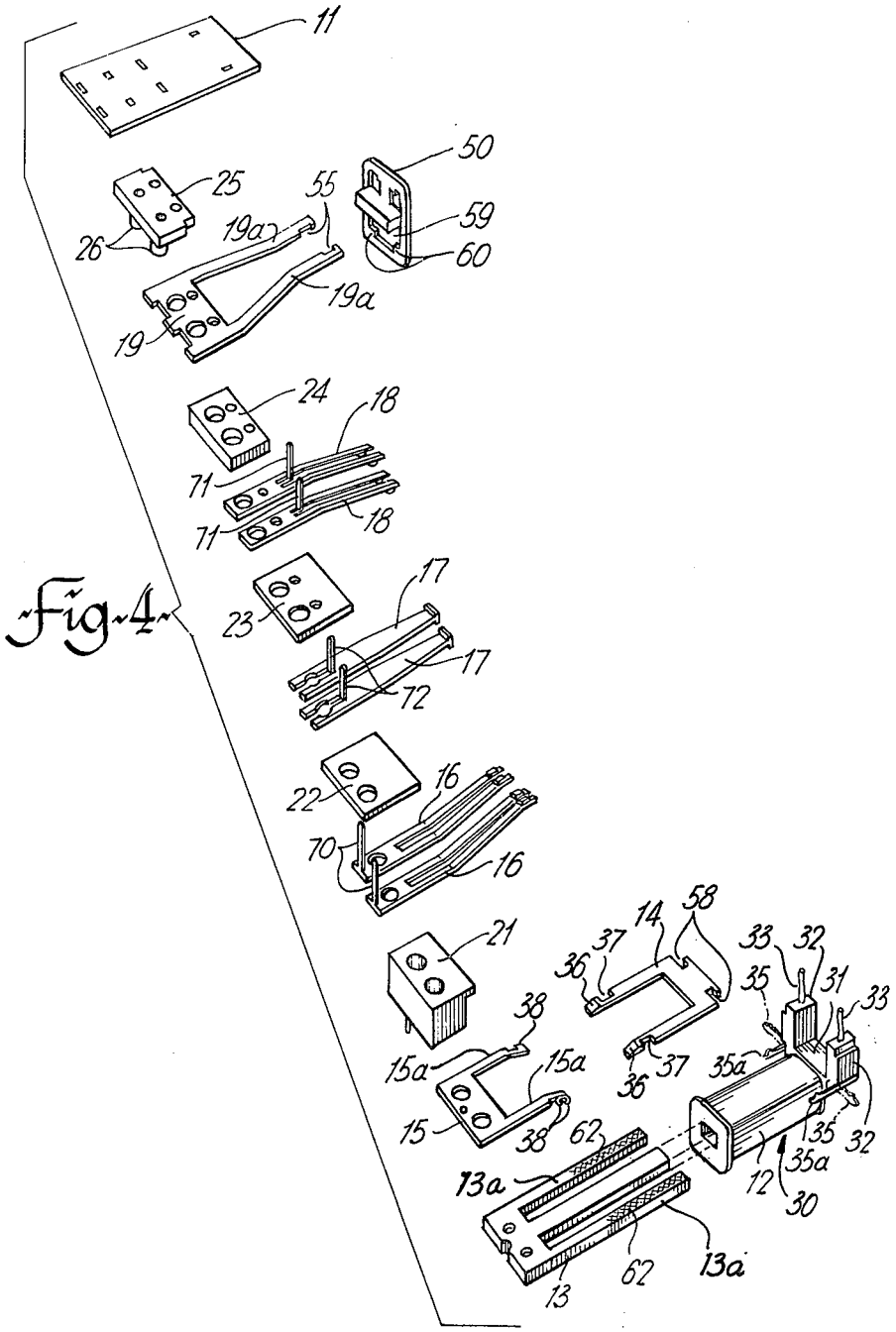
FIG. 4 is an exploded perspective view of the spring contact pile-up and actuating mechanism.

The various individual items are seen more clearly and in more detail in FIG. 4. The coil 12 is formed by a winding on a molded form 30. The molded form has a hollow spool part, on which are wound the windings, and an end extension 31. The end extension has two arms 32 extending normal to the axis of the coil and also normal to the plane of the core 13. In the arms 32 are positioned two contact strips 33, the ends remote from the core axis eventually passing through the base 11 of the relay, as indicated at 34 in FIG. 1. Other ends of the contact strips 33 initially extend outwards from the coil axis, as indicated by dotted outline 35. After connection of the winding ends to the ends 35 they are bent to lie parallel to the coil axis, at 35*a*. This ensures some slack in the connections to the ends 35. The core has two side legs 13*a* extending from the bottom part of the core, spaced from and extending parallel to the centre leg of the core.

Positioned next to the core 13 is the armature 14 and hinge spring 15. Normally the hinge spring is permanently attached to the armature, as by brazing, spot welding, or similar. This sets up a fatigue sensitive position at the attachment and cracking can occur. The action of the hinge spring is to pull the armature 14 away from the core 13 when the coil is not actuated. In FIG. 3 the relay is shown actuated, that is the coil is connected to an electrical supply and the core 13 has attracted the armature 14 against the action of the hinge spring and the contact springs. Contacts have been actuated as will be described.

Figure 5:
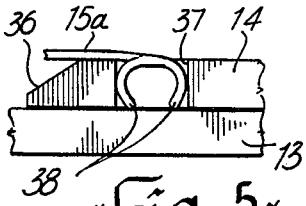
FIG. 5 is an enlarged view of the hinge attachment between armature and hinge spring.

The hinge spring is U shaped having a base portion attached to the bottom part of the core and two parallel spaced apart legs 15*a* positioned over the side legs of the core. The connection of the armature to the hinge spring, in the present invention avoids the formation of fatigue sensitive positions. As seen in FIG. 4 and also in larger scale in FIG. 5, the ends of the legs 14*a* of the armature 14 are chamfered at 36 and a recess 37 is formed at the side of each leg. At the end of each leg 15*a* of the hinge spring is formed a pair of tangs 38. Seen in side view, as in FIG. 5, the pair of tangs present a somewhat C shaped configuration, the mouth of the C facing down. Each C shaped configuration is a fairly close fit in a recess 37. In assembly, the coil 12 and core 13, hinge spring 15, and springs and insulators are first assembled and screwed together. The armature 14 is then assembled to the hinge spring by sliding the armature along the core, with the legs 14*a* of the armature sliding on the core. When the legs 14*a* of the armature 14 meet the legs 15*a* of the hinge spring 15, the chamfers 36 act on the tangs and lift the legs 15*a* of the hinge spring up. The C shaped formation slides over the ends of the legs 14*a* of the armature and drop into the recesses 37. Assembly is very easy and cheap, being cheaper than brazing or staking and avoiding fatigue problems. Some care is needed in providing acceptable dimensions. Thus the chamfers 36 must be such that the ends of the legs 14*a* will lift up the legs of the hinge spring. The distance between the end of the chamfer and the wall of the recess nearest the chamfer must be slightly larger than the distance across the mouth of the C shape — i.e. between the ends of the tangs 38.

Once the armature is assembled to the hinge spring it is quite firmly attached and will stand up to heavy mishandling of the relay, such as by dropping.

The operating card 20 is arranged to act on the contact springs 16 and 18 as close to the contacts as possible. By this it occurs that the amount of movement of the contacts is substantially the same as the movement of the card. Conventionally the card contacts the contact springs a short distance away from the contacts and there is some movement differential — the movement of the card being slightly more than that of the contacts. While the differences may be small, in very small relays, with which the present invention is particularly concerned, even small reductions in armature movement are extremely important.

Figure 6:
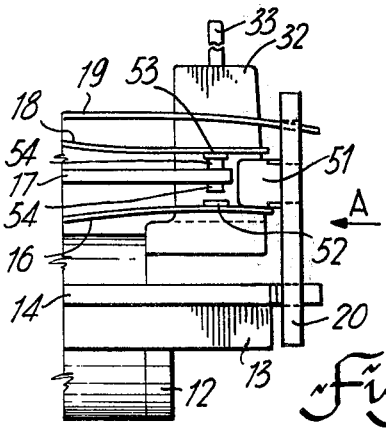
FIG. 6 is a cross-section on the line V—V of FIG. 2 to an enlarged scale to illustrated the cooperation between operating card and spring contacts.
Figure 7:
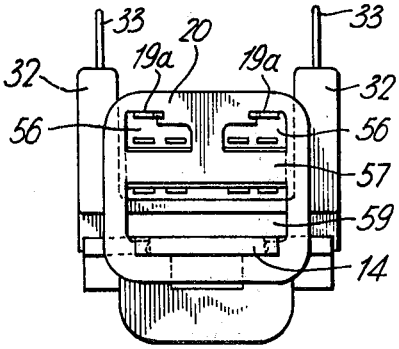
FIG. 7 is an end view on FIG. 6 in the direction of the arrow A.

The card 20 is provided with an extension - seen more clearly in FIG. 6. The extension 51, is positioned between the ends of the contact springs 16 and 18, and is very close to the contacts 52 and 53 on the contact springs 16 and 18 respectively. Corresponding contacts 54 are on each side of the transfer spring 17. The operating card 50 is carried on the ends of the legs 19*a* of return spring 19. Two small recesses 55 are formed near the outer ends of the legs 19*a*. The legs 19*a* pass through apertures 56 in the card 20 and narrow parts of the apertures engage with the recesses 55. This can be seen in FIG. 7. The extension 51 is carried by a central bar 57.

The card 20 is also carried on the end of the armature 14. The outer end of the armature is provided with a small channel or undercut 58 (FIG. 4) at each edge. The card has a further aperture 59 through which passes the end of the armature 14, and small protrusions 60 at two corners of the aperture 59 engage with the channels 58. Thus movement of the armature 14 is transmitted via the operating card 20 to the contact springs 16 and 18.

With the very small movements of the armature, and small clearances, sticking of the armature to the core, as a result of residual magnetism, can be a problem. While such a problem has been reduced considerably by the use of special alloys, it can still occur, particularly if manufacturing tolerances happen to build up in a particular manner to reduce clearances, etc. In the relay of the present invention, additional protection against armature sticking can be provided.

Two features can be provided to ensure correct armature operation. Firstly, the surface 62 of the side legs 13*a* of the core 13, which the armature 14 contacts on actuation, is knurled to provide a slightly roughened surface as indicated in FIG. 4. Secondly, the side legs 13*a* are bent slightly out of the plane of the major part of the core. In particlar, in the present example, the legs are bent upward as viewed in FIG. 4. The bending is extremely small, typically about 0.005 inch. Both these provisions create a localized air gap between armature and core, when the core is energized and armature actuated, avoiding sticking.

The base plate 11 is of molded form and small depressions are formed in what will be the inner surface of the base plate when assembled to the case and assembled relay. The depressions extend part way through the base plate.

The various contact springs, that is contact springs 16 and 18 and transfer spring 17, have terminals 70, 71 and 72 respectively which extend from the base plate. The outer ends of the terminals are pointed, and after assembly of the relay into the case 10, the base plate is pushed on over the terminals. The ends of the terminals locate in the depressions on the inner surface of the base plate and cut their way through the remaining thickness. This provides a good seal around the terminals.

For optimum operation of the contacts 52, 53 and 54 it is desirable that the transfer spring 17 be completely rigid while the contact springs 16 and 18 be infinitely flexible. For manufacturing reasons, some compromise must be made, and the transfer spring does have some flexibility. To increase the rigidity of the transfer spring 17 the insulators 22 and 23 are made longer than usual and extend further along the transfer spring, as indicated at 73 in FIG. 3. This extension of the insulators 22 and 23 does not interfere with the spring contacts 16 and 18, and is an aid towards reducing chatter at the contacts.

It is desirable to control the amount of movement of the armature, and in particular it is at least preferable that the disengaged or released position of the armature be controlled. Conventionally this is obtained by a separate part which is adjustable after assembly to give the correct positioning. In the present invention this control can be obtained by a stop 75 molded as part of the coil bobbin or molded form 30. Stop 75 is a localized protrusion and serves to locate the outer end of the armature in the released or disengaged position. This in turn controls the movement of the aperture card and locates the card also when in the inoperative position.

It will also be seen, particularly from FIG. 1, that the housing protects the contacts and other moving parts of the relay from physical damage, but any contaminants can escape. Thus there is no gas build up as a result of operation of the relay.

What is claimed is:

1. A miniature electrical relay including a hollow housing, a base plate closing the housing and a relay mechanism in said housing, said relay mechanism comprising:

a core and coil assembly, said core including a bottom portion and a central leg extending from said bottom portion, said coil positioned on said central leg, and further including two side legs, one on each side of said central leg extending parallel thereto and spaced therefrom;

an armature adjacent said core and actuated thereby;

means pivotally mounting said armature for movement toward and away from said core;

a series of contact springs positioned in stacked sequence on the side of said armature remote from said core;

an insulating member positioned between each adjacent pair of contact springs;

an operating card mounted at one end on said armature and including formations engaging with said series of contact springs for actuation thereof on movement of said armature towards and away from said core;

said armature of U shape and including two parallel spaced apart legs extending towards said bottom part of said core;

said means pivotally mounting said armature comprising a hinge spring attached to a bottom part of said core, said spring of U shape and including two parallel spaced apart legs extending towards an upper part of said core, said legs of said hinge spring and of said armature in overlapping relationships at their ends, and interengaging formations on said ends releasably attaching said armature to said hinge spring.

2. A relay as claimed in claim 1, said interengaging formations comprising a recess in each leg of said armature, and a tang formation at the end of each leg of said hinge spring, said tangs formations engaging in said recesses.

3. A relay as claimed in claim 1, said series of contact springs and said insulating members attached at a lower end to said bottom part of said core, said contact springs each including contacts at an upper end remote from said lower end.

4. A relay as claimed in claim 3, said series of contact springs including a central transfer contact spring and a contact spring on each side thereof, said insulating members on each side of said transfer contact spring extending for a substantial distance up said transfer contact spring to increase the rigidity of said transfer contact spring.

5. A relay as claimed in claim 3, including a central transfer contact spring and a contact spring on either side of said transfer spring, said upper ends of said contact springs extending a short distance beyond said central transfer contact spring, said operating card extending over said upper ends of said contact springs and including an extension extending between said upper ends of said contact springs, said extension in contact with said contact springs immediately adjacent to said contact on said contact springs.

6. A relay as claimed in claim 1, said core including a surface contacted by said armature on energization of said coil, said surface of roughened formation to reduce the contact area between armature and core.

* * * * *